US006048614A

United States Patent [19]

Rohrbach et al.

[11] Patent Number: 6,048,614

[45] Date of Patent: Apr. 11, 2000

[54] ELECTRICALLY CHARGED FILTRATION MEDIA

[75] Inventors: Ronald P. Rohrbach, Flemington, N.J.; Gordon W. Jones, Toledo, Ohio; Peter D. Unger, Convent Station, N.J.; Daniel E. Bause; Lixin Xue, both of Morristown, N.J.; Russell A. Dondero, N. Arlington, N.J.

[73] Assignee: AlliedSignal Inc., Morristown, N.J.

[21] Appl. No.: 08/975,024

[22] Filed: Nov. 20, 1997

Related U.S. Application Data

[63] Continuation-in-part of application No. 08/758,039, Nov. 27, 1996, Pat. No. 5,744,236.

[51] Int. Cl.[7] ..... D02G 3/00

[52] U.S. Cl. ..... 428/372; 428/364; 428/397; 428/398; 428/399; 442/337; 442/338; 442/417; 264/177.13

[58] Field of Search ..... 428/372, 364, 428/397, 398, 399; 55/522, 527, 528; 210/500.21, 500.23, 506, 502.1; 264/177.13; 442/337, 338, 417

[56] References Cited

U.S. PATENT DOCUMENTS

| | | | |
|---|---|---|---|
| 4,592,815 | 6/1986 | Nakao | 204/165 |
| 4,990,813 | 2/1991 | Paramo | 310/309 |
| 5,057,368 | 10/1991 | Largman et al. | 428/397 |
| 5,246,637 | 9/1993 | Matsuura et al. | 264/22 |
| 5,622,313 | 4/1997 | Lader et al. | 239/3 |
| 5,637,136 | 6/1997 | Horinka et al. | 106/14.5 |
| 5,658,641 | 8/1997 | Berrigan et al. | 428/152 |
| 5,744,236 | 4/1998 | Rohrbach et al. | 428/372 |
| 5,759,394 | 6/1998 | Rohrbach et al. | 210/264 |
| 5,871,845 | 2/1999 | Dahringer et al. | 428/378 |

*Primary Examiner*—William Kryriski
*Assistant Examiner*—J. M. Gray

[57] ABSTRACT

A nonwoven filter media or mat (1) formed from a plurality of elongated generally hollow fibers (20) each having an internal cavity (22) which has an opening (24), smaller than the cavity width, to the fiber (20) surface and each retaining within its internal cavity (22) an electrically chargeable powder particle material. The electrically chargeable material can be a pure electrically chargeable dielectric powder material or a mixture of oppositely chargeable dielectric powder particles (18). The small solid particles (18), which can be PTFE, CTFE, halogenated polymers or any other electrically chargeable dielectric powder particles, are permanently entrapped within the longitudinal cavities (22) of the fibers (20) without the use of an adhesive. The electrically charged material remains within the wicking fiber cavities (22) and generally does not enter the space between the wicking fibers yet through the longitudinal openings (24) the electrically charged material is in full communication with the fluid stream flowing past the fibers (20).

18 Claims, 3 Drawing Sheets

ELECTRICALLY CHARGED FILTRATION MEDIA

CROSS-REFERENCE TO RELATED APPLICATION

This application is a continuation-in-part of U.S. patent application Ser. No. 08/758,039 now U.S. Pat. No. 5,744,236, titled "Hollow Fibers Impregnated With Solid Particles" filed Nov. 27, 1996 and assigned to the assignee of the present application.

BACKGROUND OF THE INVENTION

1. Field of the Invention

This invention relates to a fluid cleaning system and more particularly to a permanent electrically charged shaped fiber filtration media.

2. Description of Prior Art

It is known to produce electrically charged filters. However, present electrically charged filtration media are very expensive and prone to lose their charge depending upon the environment in which they are used. The electrically charged media better known as electret media is very expensive and the charge can be permanently lost. Triboelectric media has been prepared in a number of ways including 1)woven glass fabrics which are coated with a PTFE powder dispersion, 2) filters consisting of a series of polyester media and nylon media in series behind each other, and 3) melt processed CTFE and PTFE fibers.

Triboelectrification is the process by which two specific materials in surface contact can accumulate opposite electrical charges on their surfaces. The phenomenon originates in the transfer of electrons close to the surface from one material to the other. In order for triboelectrification to occur it is not essential for one surface to cause friction on the other surface. By trying out different pairs of materials, triboelectric series have been established which lists materials starting with those which most easily accept a positive electrical charge and ending with materials which most easily accept a negative electrical charge. In theory the triboelectrification effect achievable is dependent on the dielectric constant of the materials used. R. P. Lehman in an 1988 article entitled "Optimized Powder Coating of Critical Objects", provides an exemplary list of such materials, in descending order of their relative dielectric constants from the positive end to the negative end. To achieve maximum chargeability it is believed the two materials should differ considerable in their dielectric constants.

SUMMARY OF THE INVENTION

The present invention is for a method to prepare an electrically charged filtration media in which a shaped wicking fiber filter media is impregnated with a triboelectric material, which is an electrically chargeable dielectric powder, which develops an electric charge and is continuously able to regenerate this electrical charge. The present invention provides an electrically charged flexible fiber filter wherein a mixture of different types of very small oppositely chargeable dielectric powders are entrapped, without the use of an adhesive, within longitudinal cavities formed in the shaped wicking fiber. The shaped wicking fibers can also be impregnated with a dielectric powder wherein the powder particles are formed from the same type of material which are chargeable, with respect to the shaped polymer fiber material, to an electrical potential with an opposite polarity. The interaction between the shaped polymer fiber and the small chargeable dielectric powder particles, all formed from the same material or from materials all chargeable to the same polarity with respect to the polymer fiber, yields the triboelectrification effect.

A plurality of the shaped fibers are formed into a filter mat. The fibers have longitudinal extending internal cavities which have openings extending to the outer surface of the fibers. The small electrically chargeable dielectric powders, generate the triboelectric effect by interacting with each other and/or with the shaped polymer fiber. The fiber, the opening size and the small electrically chargeable dielectric powders to be entrapped are selected so that when the dielectric powder particles are forced into the longitudinal cavities they are permanently retained. The fibers selected provide a way to mechanically immobilize the small electrically chargeable dielectric powder particles without the use of an adhesive. The powdered electrically chargeable dielectric particles become mechanically trapped within the longitudinal cavities of the fibers and are basically irreversible bound. This invention provides flexible fibers, each having a cross section with internal cavities having openings leading to the surface of the fiber, which are impregnated with triboelectric materials which are small electrically chargeable dielectric particles.

In the disclosed embodiments with electrically chargeable dielectric powder particles, the internal cavities which extend longitudinal along the lengthwise direction of the fiber, are filled with very small electrically chargeable dielectric powder particles which are permanently retained in the cavities and will not spill out through the openings due, we believe, to mechanical restrictions. The fibers are dusted with the electrically chargeable dielectric powder particles and then rolled, forcing the particles into the fiber cavities. The excess electrically chargeable particles are physically removed by agitation and a strong air flow. The electrically chargeable particles entrapped in the cavities are surprisingly stable and resistant to physical action. The present invention should be technically superior and have a significant cost savings over the present prior art electret media.

BRIEF DESCRIPTION OF DRAWINGS

For a better understanding of the invention reference may be had to the preferred embodiments exemplary of the inventions shown in the accompanying drawings in which.

DETAILED DESCRIPTION OF THE PREFERRED EMBODIMENTS

Figure 1:
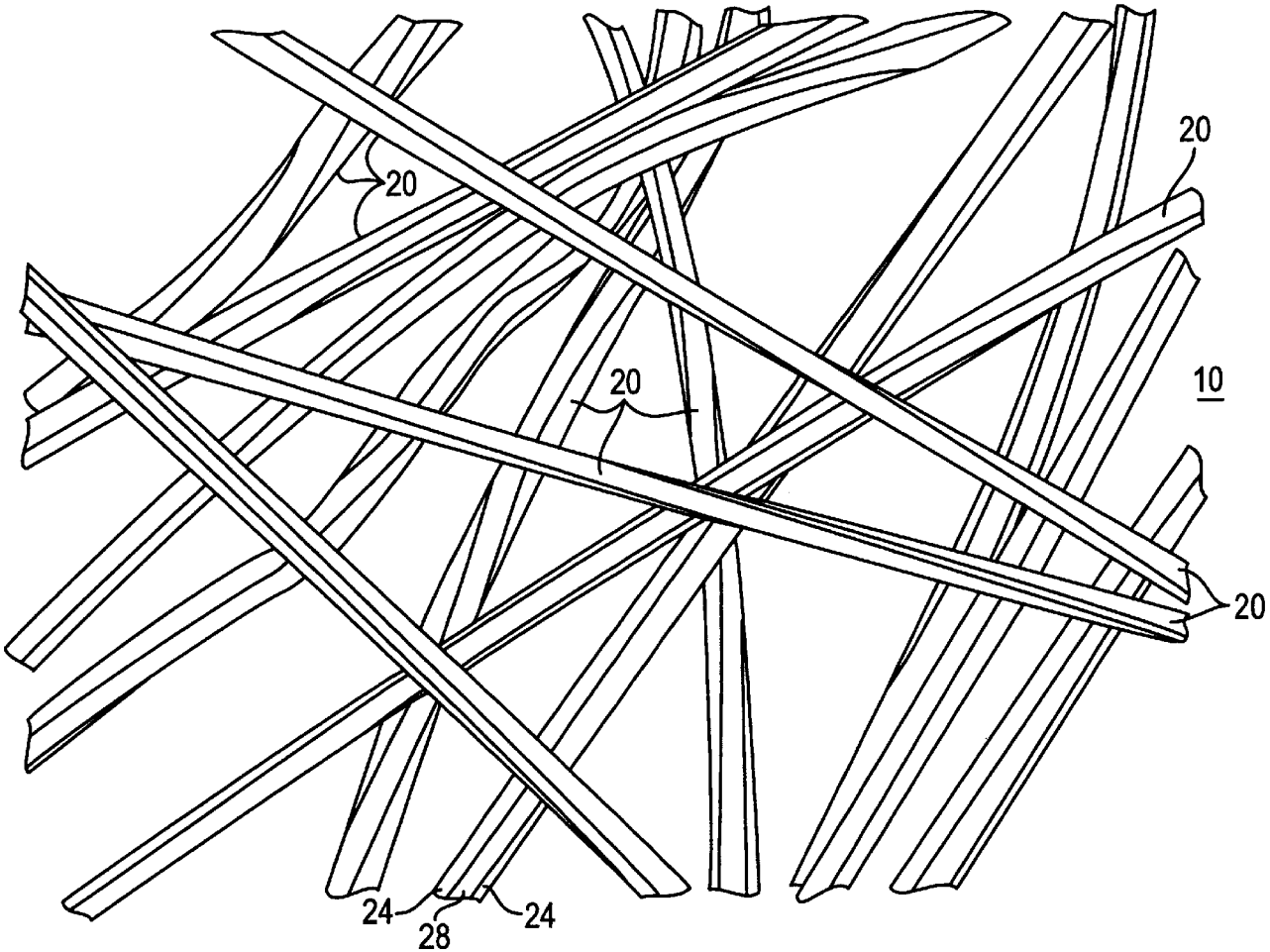
FIG. 1 is an illustration of a portion of a nonwoven fiber mat utilizing shaped wicking fibers which can be impregnated with fine electrically chargeable dielectric powder particles according to the present invention.
Figure 2:
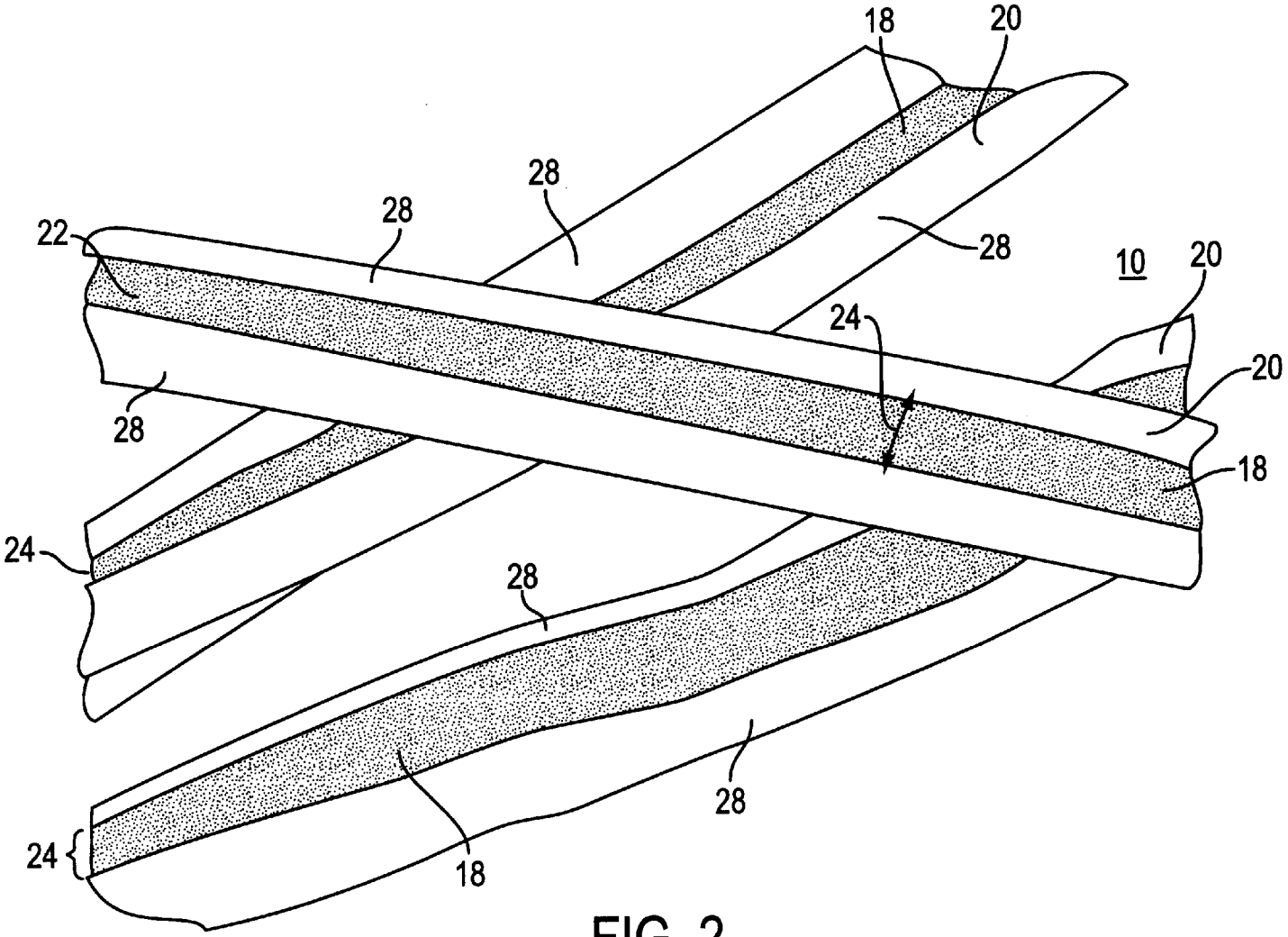
FIG. 2 is an enlarged view of a portion of the fiber mat shown in FIG. 1 utilizing shaped wicking fibers impregnated with the fine electrically chargeable dielectric powder particles according to the present invention.

Referring now to the drawings and FIGS. 1 and 2 in particular there is shown a fiber mat 10 formed from a plurality of flexible fibers 20. The flexible fibers 20 are formed into the nonwoven fiber mat 10 which can be used as an electrically charged filter element. Each fiber 20 includes an internal cavity 22 within which are disposed a mixture of either pure electrically chargeable dielectric powder particles, which are electrically chargeable to the same polarity with respect to the fiber 20, or a mixture of oppositely chargeable dielectric powder particles 18. A longitudinal opening 24 extends from each cavity 22 to the surface of each fiber 20. The multilobal fibers 20 are relatively small having a diameter of 250 microns to 10 microns or smaller. We have found that we can impregnate an electrically chargeable dielectric powder material 18 into the channels 22 of the wicking fibers 20 to produce a fiber 20 with continuous electrically charged properties. We have taken a polypropylene nonwoven media 10 and dry impregnated small electrically chargeable dielectric powder particles 18 into the channels 22 and this has resulted in a media with a permanent and continuously regenerating electrical charge. The triboelectrification is caused by interaction between the different types of particles 18 themselves and the polymer fiber 20, if oppositely chargeable dielectric powder particles 18 are used, or by the interaction between the particles 18 and the polymer fiber 20, if a single type of electrically chargeable dielectric powder particles 18 are used. The size of the small electrically chargeable dielectric powder particles 18 are approximately 0.3 microns. The fibers shown in FIGS. 1 and 2 are approximately 30 microns in diameter. The small electrically chargeable dielectric powder particles 18 become mechanically entrapped and remain within the fiber cavities 22 and generally do not enter the space between the fibers 20. The size of opening 24 is selected so when the electrically chargeable dielectric powder particles 18 are disposed in cavity 22 they are essentially permanently entrapped and cannot easily be removed. Preferably, the electrically chargeable dielectric powder particles 18 are very small generally being less than 1 micron across. An example of the invention is to impregnate a polypropylene shaped fiber filter media with finely powdered PTFE or a mixture of silica glass and PTFE; and the resulting filter will have a permanent charge due to triboelectrification.

Figure 3:
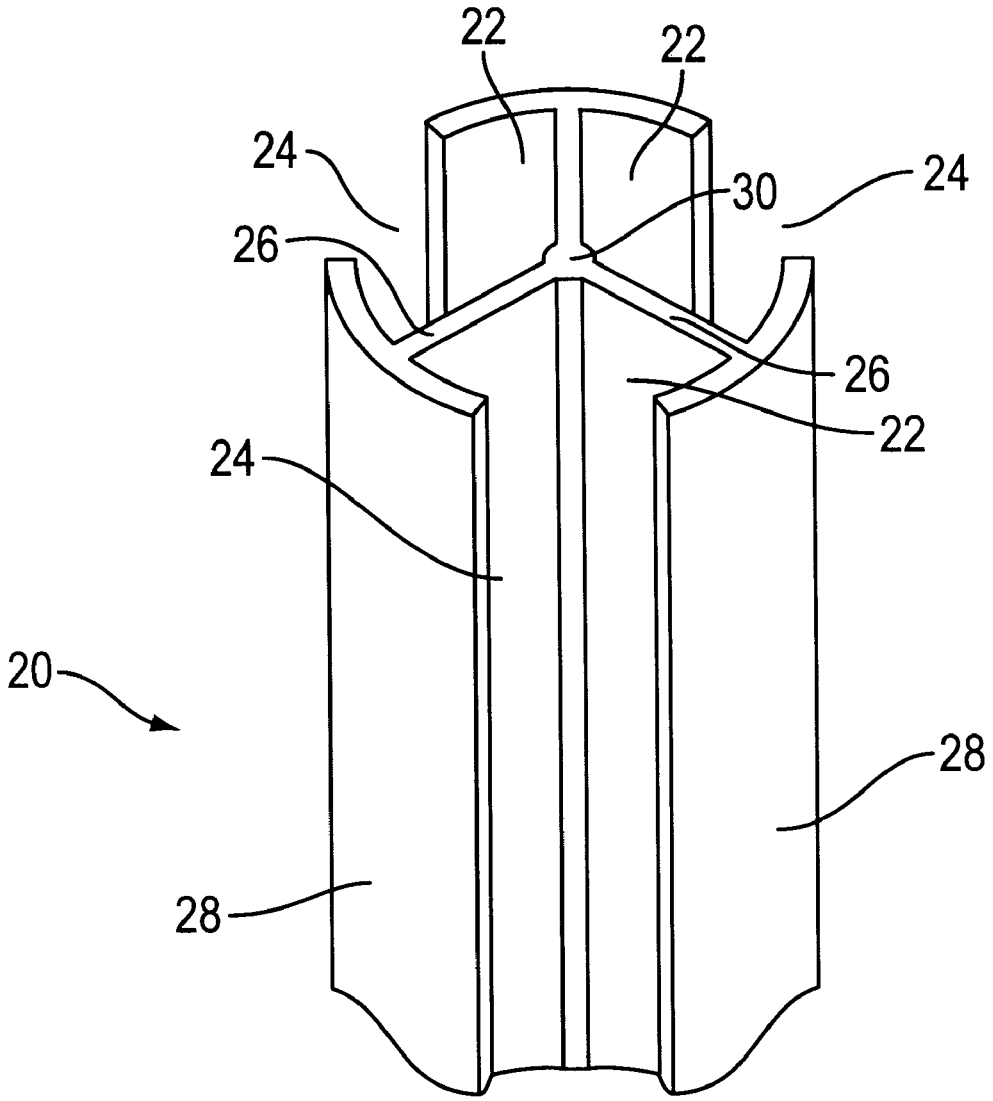
FIG. 3 is a perspective view showing a wicking fiber which is suitable for practicing the present invention.

A generally hollow fiber 20 which is suitable for practicing this invention is disclosed in U.S. Pat. No. 5,057,368 and is shown in FIG. 3. This patent discloses a trilobal or quadrilobal shaped fiber formed from thermoplastic polymers wherein the fiber has a cross-section with a central core and three or four T-shaped lobes 26. The legs of the lobes 26 intersect at the core 30 so that the angle between the legs of adjacent lobes is from about 80 degrees to 130 degrees. The fiber 20 as illustrated in FIG. 3 is formed as an extruded strand having three hollow interior longitudinally extending cavities 22 each of which communicates with the outer strand surface by way of longitudinal extending slots 24 which are defined between the outer ends of the T-shaped lobes.

As can be clearly seen in FIG. 2 the small electrically chargeable dielectric powder particles 18 are retained within the individual cavities 22 without spilling out into the inter fiber voids. The fibers 20 strongly retain the small electrically chargeable dielectric powder particles 18 within the cavities 22 so that the particles 18 will not shake off and the fiber mat 10 retains the particles 18 when touched or handled. In a filter mat 10 of such fibers 20 the area between the individual strands remains relatively free of the small electrically chargeable dielectric powder particles 18 with which the internal cavities 22 of each fiber 20 are filled. The filter mat 10 fibers 20 may be made of one or more types of material such as polyamides, polyesters, or polyolefins. The three T-shaped cross-section segments 26 may have their outer surface 28 curved, as shown, or the outer surface may also be straight. while the fiber 20 is depicted as three lobed other number of lobes are suitable. In addition other internal cavity fibers with C-shapes or other cross sections may also be suitable for retaining the small electrically chargeable dielectric powder particles 18 provided the opening from the cavity 22 is sized to retain the small electrically chargeable dielectric powder particles 18 within the fiber interior.

In forming the fiber mat 10, the solid small electrically chargeable dielectric powder particles 18 are aggressively rubbed into the fibers 20. The procedure used for dry impregnation is to take the fibers 20 and liberally dust them with the small electrically chargeable dielectric powder particles 18. The particles 18 of the electrically chargeable dielectric powder have a diameter of less than one half the shaped fiber 20 cross sectional diameter. The small electrically chargeable dielectric powder particles 18 are rolled into the fiber 20 several times. The excess small electrically chargeable dielectric powder particles 18 are physically removed by agitation aided by a strong air flow. The powder particles 18 which remain within the cavities 22 are surprisingly stable and resistant to physical action. We believe it is a keystone type mechanical entrapment effect which so tenaciously hold the particles 18 within the fibers 20. The particles 18 seem to engage one another and do not spill from the cavities 22 through opening 24. We tried impregnating trilobal fiber in which the outer ends or caps of the lobes 26 were removed. Very few electrically chargeable dielectric powder particles 18 were retained by such shaped fibers.

Basically, one application of this invention provides a simplified and low cost version of an electrically charged filter media which can replace electret media. Instead of starting with PTFE or CTFE fiber to obtain an electret fiber for a filter we start with a generally hollow shaped wicking fiber 20 and impregnate it with pure electrically chargeable dielectric powder material or a mixture of oppositely chargeable dielectric powders 18. A few examples of uses for the electrically charged filter produced according to the present invention are: high efficiency particulate filter for indoor air applications, aerosol filter for removing droplets, particulate filters for clean room applications and personal protection masks for allergens, bacteria, and viruses. Following is an example of producing an electrically charged filter media according to the present invention.

EXAMPLE

A triad media comprising a point bonded polypropylene media with a weight of 3 oz/yd and with average denier of 3 was impregnated with finely powdered PTFE. The shaped fiber media was mixed with a great excess of PTFE powder which was smaller than 0.3 micron. The PTFE powder was physically rolled into the channels of the fiber. After several rollings the shaped fiber media was removed and the excess powder blown off with high pressure air. The resulting media retained a large static charge both in high humidity and under normal environmental conditions. Other powdered materials could also replace the PTFE including CTFE and other variations of halogenated hydrocarbons along with other materials which have the potential of generating an electrical charge when they come in contact with the polymer from which the shaped fiber media is formed.

Many other materials, beyond the halogenated materials, which generate an electric charge when they come in contact with the shaped polymer fiber can also be used in practicing this invention. It is the nature of both the polymer fiber and the electrically chargeable dielectric powder which generates this charge. The different materials must be separated on the triboelectric scale in order to be effective. The greater the separation the more effective the materials will be in triboelectrification. Scientifically, it is the work function differences between each material which allows for this charge build up on each material. If two materials have substantially different work functions, which is the energy it take to remove an electron, then material contact or a frictional action will generate an electric charge which builds up on the materials. Classically, the materials used for triboelectrification are combinations of fluoropolymers and glass fibers which give good charges. Ultimately the electrical dissimilarity is critical.

We claim:

1. An electrically charged fiber filter mat comprising:

a plurality of elongated fibers, each having a longitudinally extending internal cavity including an opening from the internal cavity to the outer fiber surface;

a fine electrically chargeable dielectric powder made from particles which are smaller than the opening disposed within the internal cavities of said plurality of elongated fibers; and said fine electrically chargeable dielectric powder particles being of such a size, shape and makeup that they are securely retained within the internal cavities.

2. An electrically charged fiber filter mat as claimed in claim 1 wherein each elongated fiber is less than 250 microns in diameter and the majority of fine electrically chargeable dielectric powder particles are less than 20 microns in size.

3. An electrically charged fiber filter mat as claimed in claim 1 wherein said fine electrically chargeable dielectric powder particles are selected from the group consisting of PTFE, CTFE, and halogenated polymers containing either fluorine or chlorine.

4. An electrically charged fiber filter mat as claimed in claim 1 wherein a plurality of internal cavities, each including an opening to the outer fiber surface, are formed in each fiber.

5. An electrically charged fiber filter mat as claimed in claim 1 wherein said fine electrically chargeable dielectric powder particles are made from a mixture of oppositely chargeable particles.

6. An electrically charged fiber filter mat as claimed in claim 1 wherein said fine electrically chargeable dielectric powder particles are all made from material which is chargeable to the same polarity, which is opposite to the polarity of said plurality of elongated fibers.

7. A fiber comprising:

an elongated strand;

an internal cavity formed in said strand;

an elongated opening connecting said internal cavity to the outer surface of said elongated strand; and a plurality of small electrically chargeable dielectric particles disposed and permanently retained within said internal cavity.

8. A fiber as claimed in claim 7 wherein a plurality of internal cavities, each including an opening to the outer fiber surface, are formed in each fiber.

9. A fiber as claimed in claim 7 wherein:

the diameter of said elongated strand is less than 250 microns;

the width of said elongated opening is less than one half the strand diamter; and the average diameter of said plurality of small electrically chargeable dielectric particles is less than 1 micron.

10. A fiber as claimed in claim 7 wherein said plurality of small electrically chargeable dielectric particles are made from a mixture of dielectric particles chargeable to opposite polarities.

11. A fiber as claimed in claim 7 wherein said plurality of small electrically chargeable dielectric particles are made from a selected material so that all of said plurality of small electrically charged dielectric particles are chargeable to the same polarity, which is opposite to the polarity of said strand.

12. A fiber as claimed in claim 7 wherein said small electrically chargeable dielectric particles are selected from the group consisting of PTFE, CTFE, and halogenated polymers containing either fluorine or chlorine.

13. An electrically charged fiber comprising:

an elongated strand;

a plurality of internal channels formed in said strand;

an elongated opening connecting each of said internal channels to the outer surface of said elongated strand; and a plurality of electrically charged dielectric powder particles disposed and permanently retained within each of said internal channels.

14. An electrically charged fiber as claimed in claim 13 wherein said plurality of electrically charged dielectric powder particles are all charged to the same polarity, which is opposite to the polarity of said strand.

15. An electrically charged fiber as claimed in claim 13 wherein said plurality of electrically charged.

16. An electrically charged fiber as claimed in claim 13 wherein the electrically charged dielectric powder particles are selected from the group consisting of PTFE, CTFE, and halogenated polymers containing either fluorine or chlorine.

17. A method of manufacturing a fiber strand impregnated with electrically chargeable dielectric powder particles comprising the steps of:

a forming a fiber strand with an internal longitudinally extending cavity having a longitudinally extending opening, smaller than the cavity width, from the cavity to the fiber strand outer surface;

b. applying a plurality of the electrically chargeable dielectric powder particles to the strand;

c. forcing many of the electrically chargeable dielectric powder particles into the internal longitudinally extending cavity where they are securely retained; and d. removing the excess of the electrically chargeable dielectric powder particles which are not retained in the internal longitudinally extending cavity from the outer surface of the strand.

18. A method of manufacturing a fiber strand impregnated with electrically chargeable dielectric powder particles as claimed in claim 17 wherein the electrically chargeable dielectric powder particles are selected from the group consisting of PTFE, CTFE, and halogenated polymers containing either fluorine or chlorine. dielectric powder particles is a mixture of oppositely charged dielectric powder particles.

* * * * *